US005520217A

United States Patent [19]

Grawunde

[11] Patent Number: 5,520,217

[45] Date of Patent: May 28, 1996

[54] DIRECTIONAL VALVE

[75] Inventor: Frederick G. Grawunde, Sarasota, Fla.

[73] Assignee: Sun Hydraulics Corporation, Sarasota, Fla.

[21] Appl. No.: 105,300

[22] Filed: Aug. 11, 1993

[51] Int. Cl.[6] ..... F15B 13/043

[52] U.S. Cl. ..... 137/625.63; 91/52; 137/625.64; 251/30.01

[58] Field of Search ..... 137/625.63, 625.64; 251/30.01; 91/52

[56] References Cited

U.S. PATENT DOCUMENTS

| | | | |
|---|---|---|---|
| 2,526,709 | 10/1950 | Tait | 137/625.63 |
| 3,060,969 | 10/1962 | Aslan | 137/625.63 |
| 3,434,390 | 3/1969 | Weiss | 137/625.64 X |
| 4,011,891 | 3/1977 | Knutson et al. | 137/625.63 X |
| 4,085,920 | 4/1978 | Waudoit | 137/625.63 X |
| 4,145,956 | 3/1979 | Rumrill et al. | 137/625.64 X |
| 4,201,116 | 5/1980 | Martin | 137/625.64 X |
| 4,428,400 | 1/1984 | Tantardini | 137/625.64 X |
| 4,526,201 | 7/1985 | Geyler et al. | 137/625.63 |
| 4,649,956 | 3/1987 | Zeuner et al. | 137/625.64 X |

FOREIGN PATENT DOCUMENTS

| | | | |
|---|---|---|---|
| 72063 | 3/1960 | France | 137/625.63 |
| 2133583 | 7/1984 | United Kingdom | 137/625.63 |

OTHER PUBLICATIONS

International Publication WO83/03455 Published 13 Oct. 1983.

Pp. 34 and 35 and back cover from the Double A Hydraulic Equipment Catalog, published in Feb., 1971.

*Primary Examiner*—Gerald A. Michalsky

*Attorney, Agent, or Firm*—Watts, Hoffmann, Fisher & Heinke Co.

[57] ABSTRACT

A solenoid operated directional valve including a main section having a reciprocally mounted main fluid controlling valving member moveable between three positions in a housing. The housing defines at least two working ports and the main valving member controls fluid communication between a valve inlet and the two ports. An annular power piston assembly is coupled to the main valving member and effects movement in the valve member between three positions. A control member slidably supports both the annular piston and, an armature driven valving member which controls the communication of pressurized fluid to piston chambers. The piston defines at least one inlet associated with each chamber and housing structure defines restricted bleed passages through which pressurized fluid in the piston chambers is discharged. The control member defines passages which communicate with the piston inlets at predetermined positions of the piston and the armature driven valving member defines passages for controlling the communication of pressurized fluid to the control member passages depending on the position of the armature controlled valving member. When the armature controlled valving member is centered, the power piston is urged to the center position by both mechanical spring forces and fluid generated forces. In an alternate embodiment, a proportional valve is illustrated in which a power piston is used to incremental move a main valve member in response to movement in a control sleeve as effected by a servo motor and monitored by a linear variable differential transformer.

9 Claims, 7 Drawing Sheets

DIRECTIONAL VALVE

TECHNICAL FIELD

The present invention relates generally to fluid valves and, in particular, to a solenoid operated cartridge type, directional valve.

BACKGROUND ART

Solenoid operated fluid control valves are used throughout industry to perform a wide variety of functions. Several types of fluid control valves are available including relief valves, pressure regulating valves, ON/OFF valves and directional or shift valves.

Directional or shift valves are generally used to control the communication of pressurized fluid to one of two working ports. Generally, the valve includes a spool which may be spring or pressure centered. In the centered position, pressure at an inlet to the valve is either blocked or communicated to tank. When the spool is shifted from the center position to one of its shifted positions, pressurized fluid at the inlet is communicated to one, of the working ports, depending on the direction the spool is shifted.

Some of the currently available shift valves include a spring centered spool that is directly operated by large solenoids. In these valves, large forces must be generated by the solenoids to overcome the spring generated centering force in order to move the spool. These types of valves require substantial electrical power to energize the solenoids. Relays are generally needed to control the application of power to the solenoids.

Pilot type valves are also available which utilize low power solenoids to achieve shifting of the spool. In these pilot valves, only relatively small flow rates are accommodated and, in general, are used to control discrete valves that are separately mounted from the pilot valve.

In some currently available valves of this type, a pilot valve and a main spool are mounted in the same housing. The main spool is shifted by pilot pressure that is controlled by a solenoid operated pilot spool. The pilot spool is shifted from a center position to one of two shifted positions by actuating one of the solenoids. Pilot pressure is then directed to the main spool where it is applied to an effective pressure area on the spool. The applied pilot pressure creates a force on the spool to shift it from the center position to one of the operating positions activated.

Currently available valves of this type can be large and cumbersome. In order to service or repair many of these types of valves, partial disassembly is required in order to separate the pilot section from the main flow section. At least some of these valves require several mounting fasteners and complex gasketing in order to attach and seal the valve to the hydraulic system or hydraulic component. Repairs and replacements can therefore be costly as well as time consuming.

In some currently available direction control valves, forces needed to shift the pilot spool from its center position can be substantial. As a result, the solenoids used in these types of valves require substantial currents for operation. Many electronic controls, on the other hand, are able to provide only relatively small amounts of current, i.e., less than 1 amp to operate control devices. As a result, at least some directional valves now on the market require a separate relay to operate the solenoid coils, with the relay in turn controlled by the electronic control circuit. It is desirable to provide a directional valve that is both easy to maintain and replace and which can be directly energized by the output drive currents available from conventional electronic controls.

DISCLOSURE OF THE INVENTION

The present invention provides a new and improved directional control valve that requires relatively low currents for energizing the valve.

The type of valve disclosed herein may be referred to by various designations. For example, the valve may be referred to as a four-way solenoid operated valve, a three position four-way valve. The present invention may form part of any one of these types of valves, as well as others such as a two position four-way valve and/or a proportional valve.

According to the invention, the solenoid operated control valve includes a main fluid control section having a main valving member movable between at least two positions. In one of the two positions, the main valve member communicates fluid at an inlet with a first port and, in the second position, the main fluid member communicates with a second port, a tank port or, is blocked from communication with any other port.

According to the invention, the solenoid operated control valve also includes a power piston assembly for moving the main valve member between its operated positions and includes a piston and at least one associated piston chamber for applying fluid generated forces to the piston to effect movement in the piston. The piston is coupled to the main valve member.

In the illustrated embodiment, the main fluid control section of the solenoid operated control valve includes a main valving member that is movable between three fluid controlling positions. In one of the three positions, the main valve member communicates fluid at an inlet with a first working port and in a second position, the main fluid member communicates pressure at the inlet with a second working port. The third position is considered a center position and, in this position, the communication of the inlet with any other ports may be blocked or, alternately, the inlet may be communicated with a tank port.

In the illustrated embodiment, the power piston assembly includes a power piston having two associated piston chambers for applying forces to the piston to effect reciprocal movement in the piston. In this way, the main valve member is movable by the power piston between three discrete positions. The piston is coupled to the main valve member.

In the illustrated embodiment, valve structure defines at least one inlet and one restricted discharge passage for each piston chamber through which fluid is admitted and discharged from a piston chamber, respectively. A control member defines a plurality of passages which are each communicatable with a piston chamber inlet at predetermined positions of the piston. A piston position control system includes a solenoid operated valving member movable to at least three positions and includes fluid passages for selectively communicating a source of pressurized fluid with the control member passages that is a function of the position of the solenoid operated valving member. According to the invention, relatively small movements in the solenoid operated valving member produces substantial movements in the power piston and hence, the main valving member to which it is coupled.

According to a feature of the invention, the solenoid operated fluid control valve is constructed as a cartridge valve which is threadedly received in a complementally shaped cavity. The cavity defines ports which communicate with fluid transfer regions on a control valve. The ports in the cavity, as is known, communicate with conduits, passages, and other fluid control components through which fluid is received from, or directed to, the control valve. According to this feature of the invention, the main valving member and the solenoid operated valving member are axially aligned and preferably move along a common line of action.

According to another feature of the invention, the control member slidably supports both the power piston and the solenoid operated valving member. In the more preferred embodiment of this feature, the power piston is annular and includes tubular extensions which are slidably supported by lands formed on the control piston. In this feature, the power piston inlets are defined in the tubular extensions and communicate with selected passages defined in the control member depending on power piston position.

According to still another feature of the invention, the control valve includes a pair of solenoids and an armature. In the preferred embodiment, the armature is maintained in a centered position when neither solenoid is energized and moves to shifted positions when one of the solenoids is operated. Its shifted position depends on which solenoid is energized. A linking member links movement in the armature with the solenoid operated valving member. In the preferred embodiment, pressurized fluid for moving the piston between its operative position comprises fluid pressure at the valve inlet.

With the present invention, a compact, easily serviced, directional or shift valve is provided. When constructed in a cartridge configuration, the valve is easily installed into or removed from a complementally shaped cavity by simply threading the valve into or out of the cavity. The valve body in this configuration carries O-ring seals for providing sealing engagement between the valve and the cavity. Separate gasketing is not required nor does the valve require that it be disassembled into subassemblies in order to completely remove the valve from the hydraulic system. In addition, relatively small movements in the armature produce substantial movements in the power piston. Relatively low power levels are therefore required to effect movement in the armature and as a result, a valve constructed in accordance with the preferred embodiment of the invention, can be directly energized with the outputs from an electronic control circuit, eliminating the need for separate power relays to operate the valve.

The present invention is adaptable to a wide variety of valves. For example, the present invention contemplates the use of the power piston assembly in a relief type valve in which the power piston would be used to move a spring loaded valving member in order to change the compression or tension of a relief spring. In other words, the power piston may be used to change the relief setting in a relief type valve. The invention is also adaptable as a proportional valve in which the control member on which slidably supports the power piston is movable by a drive mechanism such as a stepper or servo motor. The power piston tracks the movement in the control member and hence can precisely position a valve member, its movement being a function of the actuation of the servo motor.

Additional features of the invention will become apparent and a fuller understanding obtained by reading the following detailed description made in connection with the accompanying drawings.

BEST MODE FOR CARRYING OUT THE INVENTION

Figure 1:
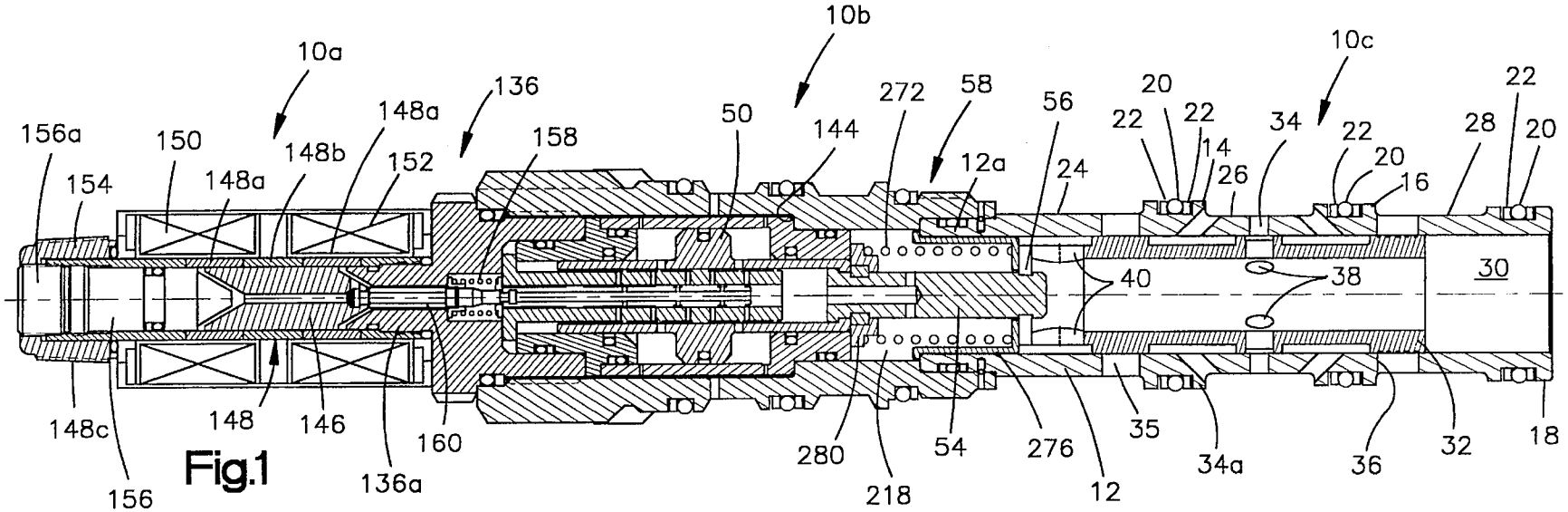
FIG. 1 is a sectional view of a fluid control valve constructed in accordance with the preferred embodiment of the invention.

FIG. 1 illustrates an electrically controlled, directional valve constructed according to one embodiment of the present invention. For purposes of explanation, the valve will be referred to as a directional valve even though it is susceptible to a wide variety of uses and applications.

In addition, the present invention is adaptable to other types of valves including remotely adjustable pressure relief valves, etc. In FIGS. 1–3B, the invention is illustrated as part of a three position four-way valve. This valve can also be designated as a four-way solenoid operated valve. However, the invention is also adaptable to valves in which a main valving component is shiftable between two positions as opposed to the three positions shown in the valve shown in FIG. 1.

The directional valve can be divided into three sections, namely, a solenoid/armature assembly 10*a*, a power piston assembly 10*b* and a main spool assembly 10*c*. The overall valve includes a plurality of external lands defining O-ring grooves that each carry a conventional O-ring and one or two backup rings.

In the illustrated embodiment, the valve is constructed as a "cartridge" valve and is intended to be mounted within a complementally-shaped, multi step bore or cavity (not shown). The O-rings sealingly engage the inside of cavity and form isolated fluid transfer regions between the valve and the cavity. As is conventional, passages and/or conduits open into the cavity and establish fluid communication between the isolated regions and other parts of the pressurized fluid system.

In the illustrated embodiment, the main spool section 10*c* includes a cylindrical multi-diameter housing 12 defining lands 14, 16, 18. Each land 14, 16, 18 defines an O-ring groove that mounts a conventional O-ring 20 and backup rings 22. These lands/O-rings define isolated fluid transfer regions 24, 26, 28. The main spool section 10*c* defines an axial inlet port 30 and slidably supports a main spool 32 which is shiftable between a center position (shown in FIG.

Figure 2:
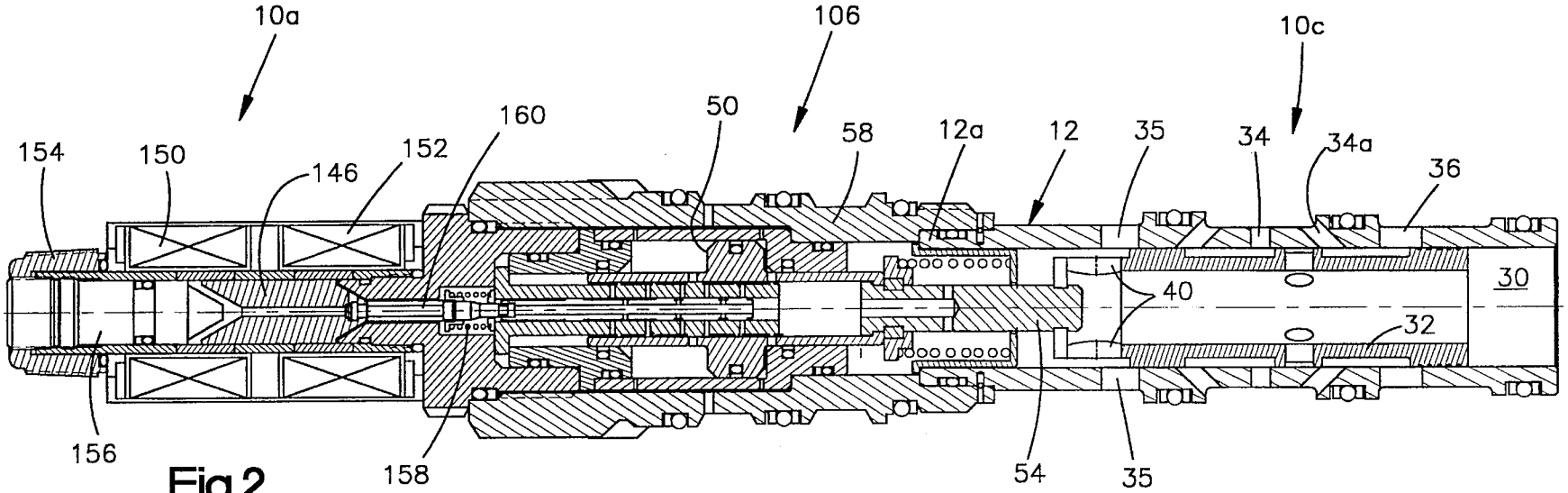
FIG. 2 is another sectional view of the fluid control valve shown in FIG. 1 with a power piston shown in a shifted position.

1) and two shifted positions, one of which is shown in FIG. 2. In the illustrated embodiment, the center region 26 defines a center port 34 which, in many applications, communicates with a tank in a hydraulic system and is essentially at atmospheric pressure. The regions 24 and 28 each define respective A and B working ports 35, 36. The center region 26 also includes auxiliary tank ports 34*a*.

When the spool 32 is in the center position, shown in FIG. 1, pressurized fluid at the inlet 30 is communicated to the tank port 34 via radial ports 38 formed in the main spool 32. In the illustrated configuration, pressurized fluid at the inlet 30 is continuously conveyed to the tank port 34 when the spool 32 is in the center position. In alternate constructions, the tank ports 38 in the spool 32 may be eliminated so that the flow of pressurized fluid into the inlet 30 is blocked when the spool is in the centered position.

When the main spool 32 is shifted to the right (as seen in FIG. 2), pressurized fluid at the inlet 30 is allowed to flow to the working port 35, via radial ports 40 formed in the main spool 32. In the illustrated configuration, the working port 36 is communicated with tank via the auxiliary tank ports 34*a* whenever the main spool 32 is shifted to the right position shown in FIG. 2. Similarly, when the main spool 32 is shifted to its left position (not shown), pressurized fluid at the inlet 30 directly communicates with the working port 36.

The main spool section 10*c* of the illustrated valve controls the communication of pressurized fluid at the inlet 30 with the center (tank) ports 34 and the working ports 35, 36 in a conventional way. It should be apparent that the ports formed in housing section 12, as well as the configuration of the ports in the main spool 32, can be reconfigured to change the fluid flow relationship between the ports and the inlet 30.

Figure 1A:
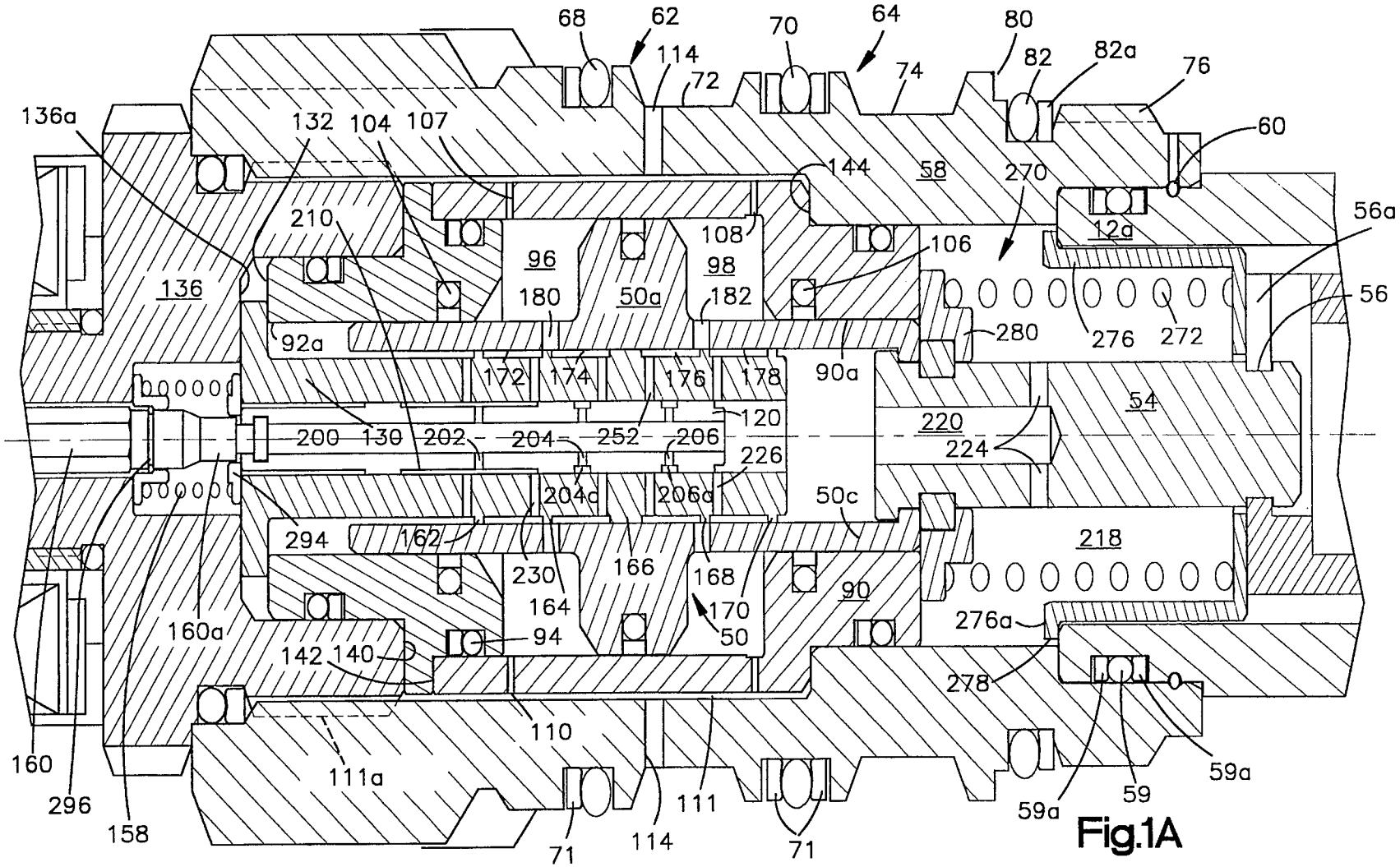
FIG. 1A is a fragmentary, sectional view of the control valve shown in FIG. 1 with its diametral dimension exaggerated in or to amplify the internal details of the valve.

The main spool 32 is shifted between its three operative positions by the power piston assembly 10*b*. The power piston section includes a reciprocally mounted power piston 50 that is operatively connected to the main spool 32 by a linking pin 54. In the preferred embodiment, the right end of the pin (as viewed in FIG. 1) includes a groove 56 which is engaged in a central opening formed in the main spool 32. Referring also to FIG. 1A, a slot 56*a* having a dimension greater than the diameter of the pin 54 extends from the central opening and enables the end of the pin 54 to be inserted into the main spool 32 in order to interconnect the pin 54 with the spool 32 as part of an assembly process.

It should be noted here that the main spool assembly 10*c* shown in FIG. 1 can be easily removed and replaced with another main spool assembly of the same or different configuration in order to accommodate different applications. As can be seen in FIG. 1, an end 12*a* of the outer housing 12 of the main spool assembly 10*c* telescopes into an external housing 58 of the power piston assembly. As seen in FIG. 1A, an O-ring 59 and a pair of conventional backup rings 59*a* seal the interface between the two housing. A locking wire 60 may be used to maintain the assemblage of the two housing 12, 58.

The construction of the power piston assembly 10*b* is best shown in FIG. 1A. The housing 58 of the assembly 10*b* defines multiple sealing lands 62, 64 which support an O-rings 68, 70 and associated backup rings 71. When the valve is installed in a suitable cavity, the lands 62, 64 and associated O-rings 68, 70 define isolated fluid transfer regions 72, 74.

The power piston assembly 10*b* also includes a threaded segment 76, by which the valve is held within the cavity. As indicated above, the cavity includes multiple bore sections of gradually increasing diameters. The valve is threaded into the cavity until a shoulder 80 formed in the housing 58 abuts a surface or seat formed in the cavity (not shown). An O-ring 82 and backup ring 82*a* seals this region of the valve to inhibit leakage.

The power piston 50 includes a piston head 50*a* slidably supported within a sleeve member 90. The left end of the sleeve as viewed in FIG. 1A, is enclosed by an intermediate cap member 92, which includes an O-ring 94 for sealingly engaging an inside bore of the member. The sleeve member 90, together with the intermediate cap 94 and associated backup ring, define piston chambers 96, 98 on either side of the piston head 50*a*. When the chamber 96 is pressurized, the piston 50 moves rightwardly as viewed in FIG. 1A and when the chamber 98 is pressurized, the piston 50 moves to the left.

Tubular extensions 50*b*, 50*c* extend from the piston head 50*a*. The extension 50*b* includes an outer cylindrical surface which slidingly engages an inside bore 92*a* defined by the intermediate cap member 92. The extension 50*c* includes an external cylindrical surface that is slidingly supported by a central bore 90*a* formed in the sleeve member 90. O-ring seals 104, 106 sealingly engage the extensions 50*b*, 50*c* and inhibit fluid leakage out of the chambers 96, 98. The sleeve member 90 includes bleed passages or orifices 107, 108 through which pressurized fluid in the piston chambers 96, 98, respectively is discharged. The passages 107, 108 both communicate with an annular passage 110 that is defined by a clearance between the sleeve member 90 and a bore surface 111 formed in the housing 58. The annular passage 110 communicates with the fluid transfer region 72 via one or more radial passages 114. In use, the region 72 communicates with the tank so that fluid discharged from the piston chambers 96, 98 (via the bleed orifices 107,108) is returned to tank.

The communication of pressurized fluid to the piston chambers 96, 98 is controlled by an armature spool 120. The piston 50 defines an axial bore 122 that slidably receives a fixed control sleeve 130. As seen best in FIG. 1A, the control sleeve 130 is held between an end face 132 defined by the intermediate cap member 92, and a radial end face 136*a* formed on a threaded end cap 136. The end cap 136 is threaded into a threaded segment 111*a* of the housing bore 111.

As seen in FIG. 1A, the threaded end cap 136 also maintains and locks the position of the intermediate cap member 92. In particular, the cap member 92 is held between an end surface 140 formed on the end cap 136 and an end surface 142 defined by the piston sleeve member 90. The piston sleeve member 90 is clamped against a shoulder 144 formed in the housing 58. In effect, the end cap 136 clamps the components 90, 92 between itself and the shoulder 144.

The position of the piston 50 with respect to the control sleeve 130 is determined by the position of the armature spool 120. Referring to FIG. 1, movement in the armature spool 120 is effected by an armature 146 forming part of the armature assembly 10*a*. The armature 146 is reciprocally slidable within a tube 148 that is secured to an extension 136*a* forming part of the end cap 136. As is conventional, the tube 148 is actually an assembly formed by two ferrous segments 148*a* spaced apart and interconnected by a non-ferrous segment 148*b*. As is known, the ferrous segments define magnetic poles for attracting the armature 146.

A pair of spaced apart solenoid coils 150, 152 are received by the tube 148 and are clamped in position by a threaded retainer 154, which is threaded onto a threaded tube segment 148*c*. The solenoid coils are easily replaced by unthreading the cap 154. A lock screw 156*a* secures an armature stop 156 which determines the leftmost position of the armature (as viewed in FIG. 1). The end cap extension 136*a* determines the rightmost stop for the armature 146 (as viewed in FIG. 1).

In the illustrated embodiment, a spring 158 maintains the armature 146 in the center position, shown in FIG. 1, when neither solenoid coil 150, 152 is energized. As should be apparent, when the solenoid coil 150 is energized, the armature 146 is pulled to the left (as viewed in FIG. 1) and when the solenoid coil 152 is energized, the armature 146 is pulled to its right position (illustrated in FIG. 2). Movement in the armature 148 is transferred to the armature spool 120 by a link pin 160.

As indicated above, the position of the power piston 50 is determined by the armature spool 120 in cooperation with the control sleeve 130. Passages and lands formed in the control sleeve 130 direct pressurized fluid to the chambers 96, 98, depending on the position of the armature spool 120.

Referring in particular to FIG. 1A, the control sleeve 130 defines five lands 162, 164, 166, 168, 170. Annular fluid passages 172, 174, 176, 178 are defined between the lands 162, 164, 166, 168, 170. When communication is established, as will be explained, pressurized fluid is admitted into the piston chambers 96, 98, via respective radial bores 180, 182 formed in the piston extensions 50*b*, 50*c*, respectively.

The armature spool includes a center bore 200 and a series of radial passages 202, 204, 206. The passages 204, 206 open into circumferential grooves 204*a*, 206*a*, respectively. The passage 202 opens into an external annular recess 210 having a substantial axial length.

It should be understood that during valve operation, most of the internal regions of the valve are at inlet pressure. The central bore 200 of the armature spool 120 communicates with the inlet 30 via passages and openings formed in various valve components. In particular, fluid pressure at the inlet is communicated to a spring chamber 218 by way of the linking pin slot 56*a* formed in the left end (as viewed in FIG. 1) of the main spool 32. The spring chamber 218 communicates with the armature spool bore 200 via a blind axial bore 220 and cross-passages 224 formed in the linking pin 54.

In FIG. 1A, the armature spool 120 is shown in its centered position. In this position, inlet pressure is communicated to the control sleeve passage 178 by the radial passages 226 in the control sleeve 130 which are in open communication with the spool bore 200 by virtue of the position of the right end of the armature spool 120. The annular control sleeve passage 172 is at inlet pressure via radial passages 230 formed in the control sleeve 130 which are in fluid communication with the armature spool center bore 200 by way of annular spool passage 210 and radial spool passages 202.

In this operational mode, the piston 50 is in a hydraulically centered or balanced position. As can be seen in FIG. 1A, the piston inlet ports 180, 182 are both in slight or impending communication with the respective control sleeve annular passages 172, 178. It must be remembered, that pressurized fluid in the piston chambers 96, 98 is continually fed to the tank via the restricted bleed ports 107, 108. Should the pressure in one chamber fall to a level below that of the other chamber, the piston 50 shifts slightly in the direction towards the chamber of lower pressure, whereby the inlet port associated that chamber will be further open to increase the flow of pressurized fluid into the chamber thereby driving the piston back towards the equilibrium position shown in FIG. 1A. For example, should the pressure in the left piston chamber 96 fall below that of the right piston chamber 98, the piston 50 will shift towards the left. As it moves leftwardly, the extent of communication between the inlet port 180 and the annular control sleeve region 172 will increase, admitting more pressurized fluid into the chamber 96 producing an increase in pressure in the piston chamber 96 which in turn drives the piston 50 rightwardly to close off communication between the annular region 172 and the inlet passage 180.

Figure 2A:
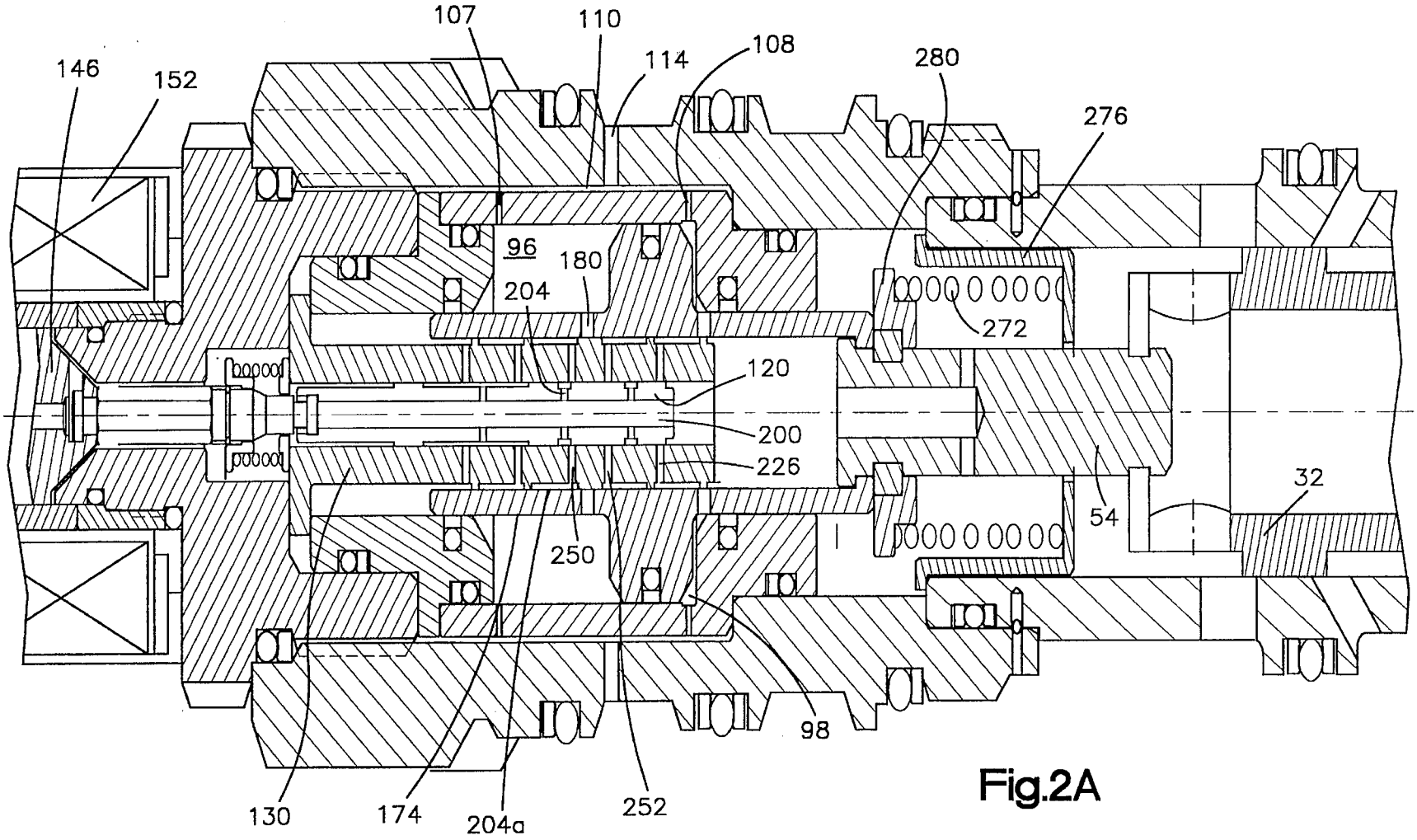
FIG. 2A is a fragmentary, sectional view of the control valve shown in FIG. 2 with its diametral dimension exaggerated in order to amplify the internal details of the valve.

FIGS. 2 and 2A illustrate the position of the valve components when the power piston 50 is shifted to the right which shifts the main spool 32 to its rightmost position, via the linking pin 54. To produce this rightward movement in the piston 50, the right armature coil 152 is energized in order magnetically pull the armature 146 to its rightmost position (shown in FIG. 2). This movement in the armature 146 moves the armature spool 120 rightwardly to the position best shown in FIG. 2A.

With the armature spool 120 shifted to the right position shown in FIG. 2A, inlet pressure is communicated to the left piston chamber 96 via piston inlet hole 180, control sleeve annular passage 174, control sleeve radial passages 250, and the aligned radial passage 204, and groove 204*a* in the armature spool 120 which communicate with armature spool bore 200. As also seen in FIG. 2A, with the armature spool 120 in the illustrated position, the flow of inlet pressure into piston chamber 98 is blocked by the armature spool 120 which isolates the radial passages 252, 226 in the control sleeve 130 from inlet pressure in the spool bore 200.

The pressure in piston chamber 98 is depleted as the fluid is discharged to tank via bleed passages 108, annular clearance 110 and tank port 114. As explained above, shifting of the power piston 50 effects movement in the main spool 32 to the position shown in FIG. 2 at which the inlet port 30 is placed in fluid communication with working port 35 via spool ports 40. The tank port 34 and working port 36 are isolated from inlet pressure.

Figure 3A:
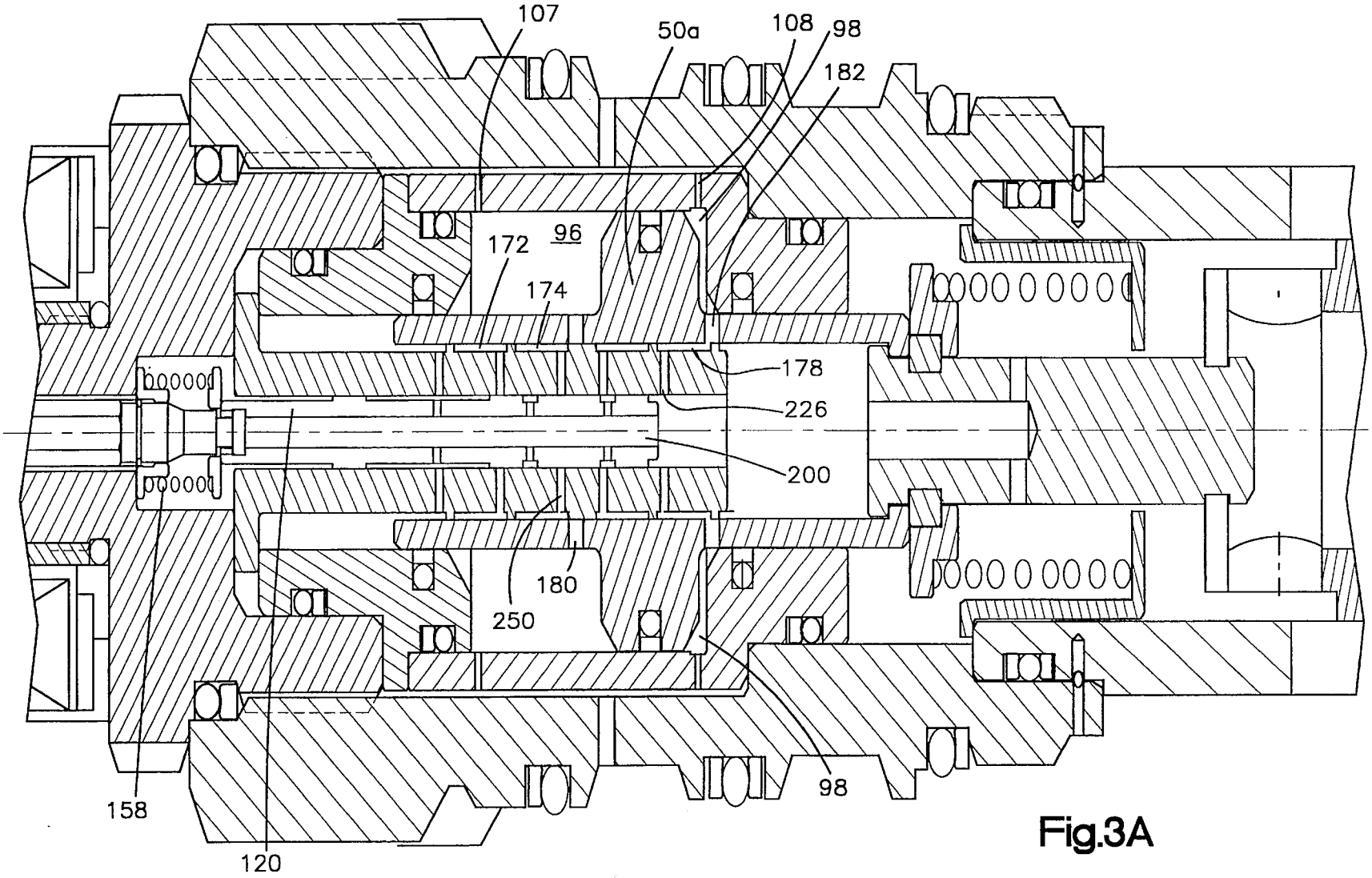
FIGS. 3A and 3B are fragmentary, sectional views of the control valve of FIG. 1, with certain components shown in alternate positions and with their diametral dimensions exaggerated in order to amplify the internal details of the valve; and, FIG. 4 is a sectional view of a fluid control valve instructed in accordance with another preferred embodiment of the invention.
Figure 3B:
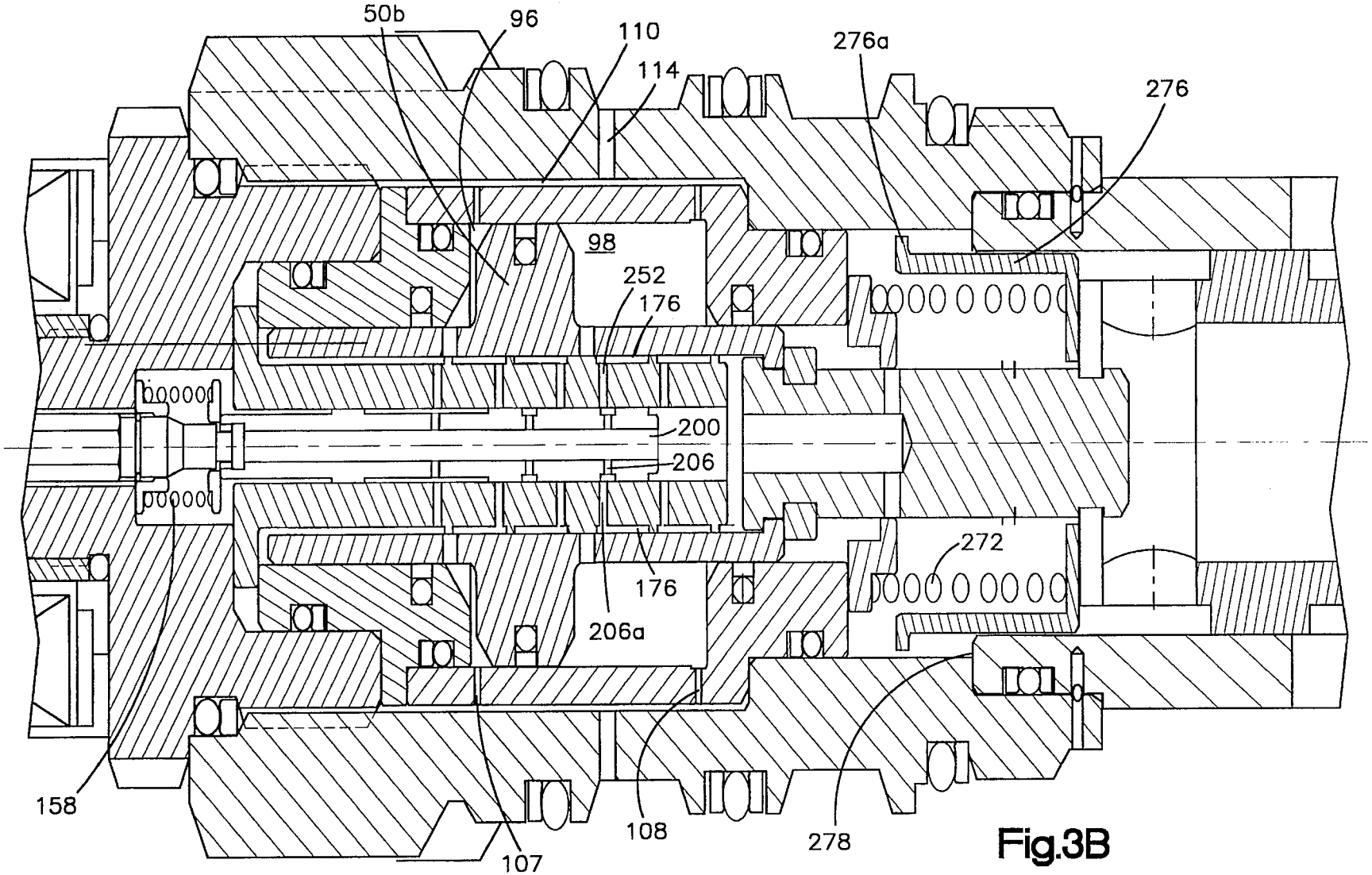

FIGS. 3A and 3B illustrate positions of valve components as the piston 50 is shifted from its rightmost position shown in FIG. 2A (and FIG. 3A) to its leftmost position shown in 3B. In order to achieve a change of position in the power piston 50, the armature spool 120 is moved to its leftmost position by activating the solenoid coil 150 and deactivating the solenoid coil 152. Energizing the solenoid coil 150 magnetizes the left armature pole and pulls the armature 146 to its leftmost position.

FIG. 3A illustrates the armature 146 and armature spool 120 in their leftmost positions and illustrates the fluid communication that occurs prior to actual movement in the power piston 50. As seen in FIG. 3A, with the armature spool 120 shifted to the left, inlet pressure is communicated to the piston chamber 98 via control sleeve radial passages 226, control sleeve annular passage 178 and piston inlet hole 182. Concurrent with establishing this fluid communication with piston chamber 98, fluid communication with piston chamber 96 is terminated since control sleeve annular passage 174 and radial passages 250 are isolated from inlet pressure by the armature spool 120. The pressurization of the chamber 98 coupled with the de-pressurization of the chamber 96 as the fluid is discharged through the bleed orifice 107 causes the piston to move leftwardly.

Referring also to FIG. 3B, as the piston 50 moves through its center position, fluid communication with piston chamber 98 is maintained by control sleeve radial passages 252, and the control sleeve annular passage 176 which communicate with the spool bore 200 via spool passages 206*a*, 206. Fluid communication with the left piston chamber 96 continues to be blocked by the position of the armature spool 120. Pressure in the chamber 96 is discharged through the bleed orifice 107 which communicates with tank port 114 via sleeve clearance 110.

When both solenoid coils 150, 152 are de-energized, the armature spool 120 is returned to its center position by spring 158 and the armature spool 120 returns to the position shown in FIG. 1A by appropriately pressurizing chambers 96 or 98 via passages 172 or 178 to thereby hydraulically centering piston 50.

According to a feature of the invention, the power piston 50 is also urged towards its center position by a spring arrangement indicated generally by the reference character 270 in FIG. 1A. With this feature, in the absence of fluid pressure, the piston 50 which is normally hydraulically centered, is driven to its center position by a tension spring 272. The spring is arranged such that it exerts tension force on the piston 50 whenever it is moved from its center or balanced position shown in FIG. 1A. In the balanced position shown in FIG. 1A, the spring 272 is held between a hat-shaped spring retainer 276 which includes a radial flange 276*a* that abuts an end face 278 formed on the main spool housing 12. When the power piston 50 moves to the left (as viewed in FIG. 1A), the main spool 32 moves leftwardly due to the interconnection provided by the linking pin 54. This movement in the main spool 32 causes the spring retainer 276 to move leftwardly thereby increasing compression in the spring 272. The position of the spring retainer 276 when the power piston 50 moves to the left position is illustrated in FIG. 3B.

When the power piston 50 moves to its right position, shown best in FIG. 2A, the end of the piston extension 50*c* abuts a spring seat 280 and drives the seat rightwardly as the piston 50 moves to the right thereby increasing compression on the spring 272. In this way, the spring 272 exerts tension forces on the power piston 50 in either direction of movement tending to "pull" the power piston toward its center position.

A similar spring arrangement is provided for the armature spool spring 158. In particular, the compression spring 158 is held between confronting spring seats 292, 294. When the armature 146 moves to the right, a locking ring 296 held by the armature linking pin 160 drives the left, hat-shaped seat 292 towards the right (shown best in FIG. 2A) thereby increasing spring tension on the spring 158. The pin 160 includes a narrow diameter portion 160*a* which is sized to slide through the opposing spring seat 294. When the armature 146 is moved to its leftmost position, the armature spool 120 engages the right spring seat 294 and drives it rightwardly (shown best in FIG. 3B), thereby increasing the spring compression on the spring 158. This spring arrangement maintains the armature spool 120 in the center position in the absence of solenoid energization.

Since the piston 50*a* is driven by inlet pressure and has a substantial effective pressure area, large forces can be generated on the piston. With the disclosed valve construction, relatively small movements in the armature 146 (which can be effected using relatively small amounts of electrical energy), produce substantial force capabilities to move the main valve spool 32 with increased stroke. For example, it has been found that a solenoid operated control valve constructed in accordance with the preferred embodiment of the invention includes an armature 146 movable normally 0.060 inches to either side of center. This relatively small increment of movement produces substantially (0.312) inches of movement in the power piston 50 on either side of center which, in turn, produces an attendant amount of movement in the main spool 32. It has also been found, that the disclosed solenoid/armature assembly 10a can be used in control valves of a multitude of sizes without requiring substantial changes in the armature spool 120, armature 146, solenoid coils 150, 152 etc. As a result, an entire range of valve sizes can be produced utilizing the same solenoid, coils, armature, and armature spool, thereby reducing manufacturing and inventory costs.

The present invention is adaptable to other types of valves. For example, the power piston assembly can be used to shift a valve operating member between two adjacent positions. This type of arrangement could be used in a remotely adjustable pressure relief valve in which the power piston would be used to change the spring load and, hence, the relief setting of the valve. In this type of arrangement, the power piston would change the compression (or tension) of a spring by shifting its position.

In the preferred embodiment, the valving components are axially aligned. The movable components, preferably, move along a common longitudinal axis. In the preferred embodiment, the directional valve is configured as a cartridge valve which is easily installed into a complementally formed cavity. With the disclosed construction, a directional control valve is easily serviced and/or replaced, is achieved.

Figure 4:
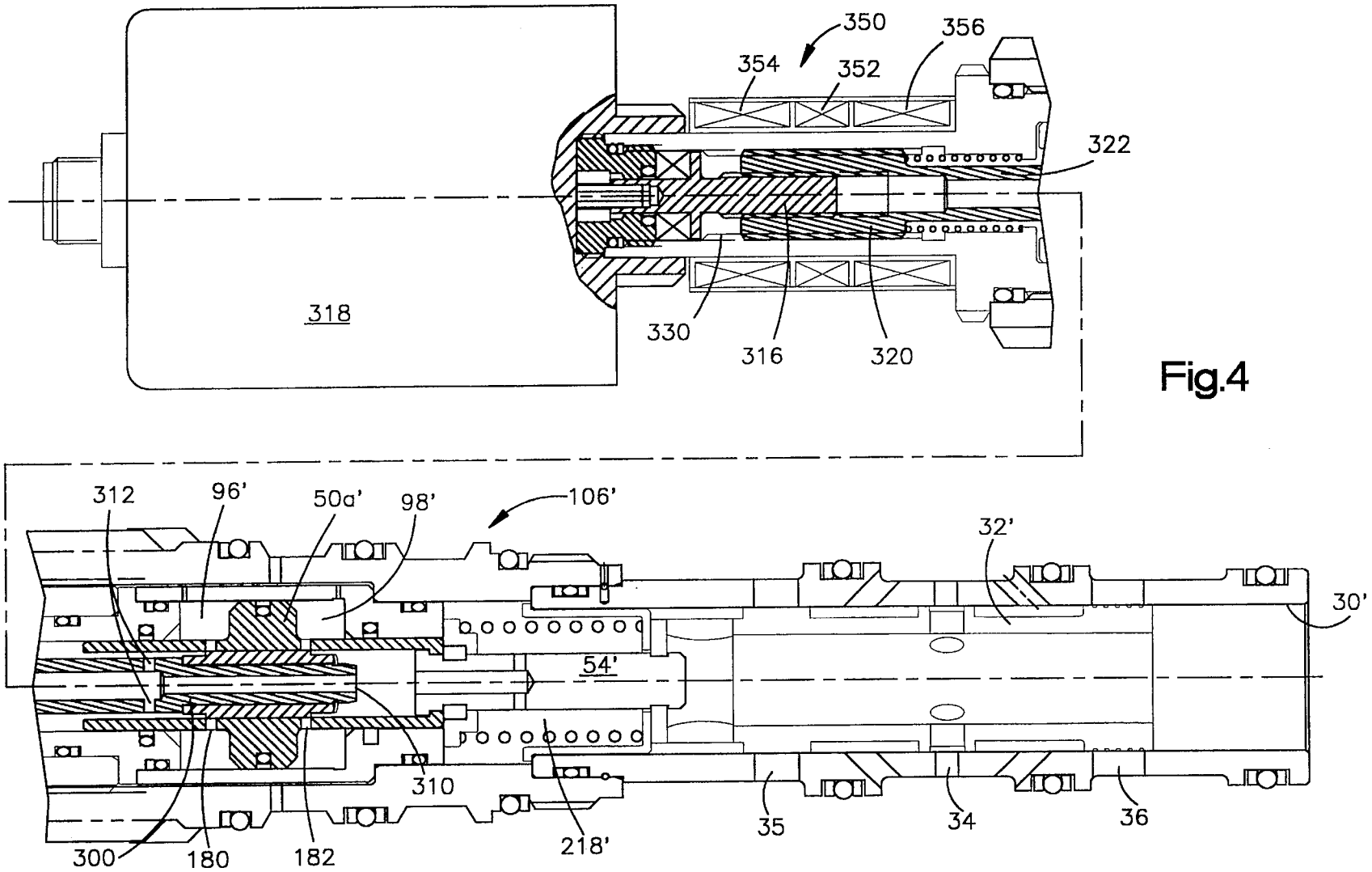

Turning next to FIG. 4, an alternate embodiment of the invention is illustrated. In the alternate embodiment, the invention forms part of a proportional valve in which a power piston assembly is used to produce incremental movement in a main valving section. To facilitate the explanation, components in FIG. 4 that are the same or substantially similar to components shown in FIGS. 1–3B, will be given the same reference character followed by an apostrophe.

The valve includes an inlet 30' and a main valving member 32' for controlling the communication of the inlet 30' with ports 34', 35', 36'. A power piston assembly including piston 50*a'* is coupled to the main valving section by a coupling arrangement including coupling pin 54' that is similar to the arrangement shown in FIG. 1.

Unlike the embodiment of FIG. 1, the piston 50*a'* is reciprocally supported on a movable control sleeve 300. The piston 50*a'* is shown in a balanced position at which piston chambers 96', 98' communicate with pressurized fluid (i.e., inlet pressure) via radial bores 180', 182'. As explained in connection with the embodiment of FIG. 1, the piston 50*a'* is hydraulically centered when both radial bores 180', 182' are about to or slightly communicate with pressurized fluid. As can be seen in FIG. 4, pressurized fluid is admitted into piston chamber 98' if the control sleeve 300 moves towards the left. Pressurized fluid as communicated through center bore 310 and a cross passage 312 is communicated to the piston chamber 96' via radial bore 180' whenever the control sleeve 300 moves towards the right from the position shown in FIG. 4. If the control sleeve moves leftwardly, fluid in the region 218' is admitted into the chamber 98' which drives the position leftwardly until the radial bore 180' is exposed and admits pressurized fluid into the chamber 96' to create a pressure balance between the chambers 96', 98'. As can be seen, the power piston 50*a'* will follow the movement of the control sleeve 300. For example, if the control sleeve 300 is moved leftwardly by ¼ of an inch, the power piston 50*a'* will move leftwardly by ¼ of an inch. The power piston 50*a'* will thus track the control sleeve 300.

By attaching a suitable drive mechanism to the control sleeve, precise movements in the power piston 50*a*' can be achieved which in turn will produce attendant movement in the main valve. In the illustrated embodiment, a servo motor 318 is attached to the left end of the valve (as viewed in FIG. 4) and includes a threaded member 316 which is threadably received by a core member 320. The core member 320 includes a coupling stem 322 which is secured to the control sleeve 300. Rotation of the servo motor produces rotation in the threaded member 316 which, in turn, causes the core member 320 to move axially rightwardly or leftwardly, depending on the direction of rotation of the servo motor. Splines 330 engage the core member 320 and prevent its rotation. Thus, the core member is restricted to axial movement only.

In order to monitor the position of the core member, a linear variable differential transformer (LVDT) is used. The core member 320 is constructed of a suitable transformer material so that it will conduct flux. Mounted between the servo motor and the valve body 10*b*' is a coil assembly 350. The coil assembly includes a center power coil 352 and adjacent sensing coils 354, 356. As is known, a transformer is formed between the coils and the core member 320. When the power coil 352 is energized, flux is transferred to the sensing coils 354, 356 by the core member 320. The amount of flux transferred to the sensing coils depends on the position of the core member 320. By monitoring the sensing coils 354, 356, i.e., determining the voltage and/or current induced in each coil, the position of the core member 320 and, hence, the position of the power piston 50*a*' and main valve section can be determined. In effect, a feedback system is formed in which activation of the servo motor 318 to produce movement in the power piston 50*a*' is monitored by the coil assembly 350. The coils determine the position of the core member and, hence, the main valve. As a result, the valve as shown in FIG. 4 acts as a proportional valve in which the position of the main valve member 32' is proportional to the extent of actuation of the servo or stepper motor 318. Very precise valve positioning can be achieved with the apparatus shown in FIG. 4, resulting in a very precise and reliable proportional valve.

Although the invention has been described with a certain degree of particularity, it should be understood that those skilled in the art can make various changes to it without departing from the spirit or scope as hereinafter claimed.

I claim:

1. An electrically operated fluid control valve, comprising:

a) a main fluid control section, comprising:
  i) a valve operating member reciprocally movable within a housing between at least two operative positions;
  ii) said valve operating member operative to control the communication of pressurized fluid between a first port and another port;

b) a power piston assembly for moving said valve operating member between said two positions, said power piston assembly comprising:
  i) a piston reciprocally movable between at least two positions, said power piston being annular and including tubular extensions;
  ii) structure defining piston chambers for applying fluid generated forces on said piston in order to produce reciprocal movement in said piston;

c) linking member for interconnecting said piston with said valve operating member such that movement in said piston produces attendant movement in said valve operating member;

d) structure defining at least one inlet and one restricted discharge passage for each piston chamber through which fluid in said piston chamber is admitted and discharged, respectively;

e) control member defining a plurality of passages each of said passages communicatable with said piston chamber inlets at certain positions of said piston;

f) piston position control system, comprising:
  i) a solenoid operated valving member movable to at least two positions, said valving member defining fluid passages for selectively communicating a source of pressurized fluid with said control member passages as a function of the position of said solenoid operated valving member; and, g) said power piston being slidably supported by said control member and said piston chamber inlets being defined in said tubular extensions.

2. An electrically operated fluid control valve, comprising:

a) a main fluid control section, comprising:
  i) a valve operating member reciprocally movable within a housing between at least two operative positions;
  ii) said valve operating member operative to control the communication of pressurized fluid between a first port and another port;

b) a power piston assembly for moving said valve operating member between said two positions, said power piston assembly comprising:
  i) a piston reciprocally movable between at least two positions;
  ii) structure defining piston chambers for applying fluid generated forces on said piston in order to produce reciprocal movement in said piston;

c) linking member for interconnecting said piston with said valve operating member such that movement in said piston produces attendant movement in said valve operating member;

d) structure defining at least one inlet and one restricted discharge passage for each piston chamber through which fluid in said piston chamber is admitted and discharged, respectively;

e) control member defining a plurality of passages each of said passages communicatable with said piston chamber inlets at certain positions of said piston;

f) piston position control system, comprising:
  i) a solenoid operated valving member movable to at least two positions, said valving member defining fluid passages for selectively communicating a source of pressurized fluid with said control member passages as a function of the position of said solenoid operated valving member; and, g) said control member slidably supporting both said power piston and said solenoid operated valving member.

3. An electrically operated fluid control valve, comprising:

a) a main fluid control section, comprising:
  i) a valve operating member reciprocally movable within a housing between at least two operative positions;
  ii) said valve operating member operative to control the communication of pressurized fluid between a first port and another port, said first port forming an inlet and said other port forming a first working port;

iii) said valve operating member including a main valving member reciprocally movable between three fluid controlling positions, said main valving member being operative to direct pressurized fluid at said inlet port to said first working port when in one of said three positions and operative to communicate pressurized fluid at said inlet port with a second working port in a second of said three positions;

b) a power piston assembly for moving said valve operating member between said two positions, said power piston assembly comprising:

i) a piston reciprocally movable between at least two positions;

ii) structure defining piston chambers for applying fluid generated forces on said piston in order to produce reciprocal movement in said piston;

c) linking member for interconnecting said piston with said valve operating member such that movement in said piston produces attendant movement in said valve operating member;

d) structure defining at least one inlet and one restricted discharge passage communicating with each piston chamber through which fluid in said piston chamber is admitted and discharged, respectively, said one inlet being spaced from said one discharge passage and said restricted passage of each piston chamber being in fluid communication with a tank pressure;

e) control member defining a plurality of passages each of said passages communicatable with said piston chamber inlets at certain positions of said piston; and, f) piston position control system, comprising:

i) a solenoid operated valving member movable to at least two positions, said valving member defining fluid passages for selectively communicating a source of pressurized fluid with said control member passages as a function of the position of said solenoid operated valving member;

g) said piston and said solenoid operated valving member being reciprocally movable between three positions;

h) said valving member and said solenoid operated valving member being axially aligned.

4. The apparatus of claim 3, wherein said control member slidably supports both said power piston and said solenoid driven spool.

5. The apparatus of claim 3, wherein said power piston is annular and includes tubular extensions, said power piston being slidably supported by said control member and said piston chamber inlets being defined in said tubular extensions.

6. The apparatus of claim 3, further comprising:

i) an armature movable between at least three positions;

ii) solenoid coils for effecting movement in said armature; and, iii) a second linking member for linking said armature with said solenoid driven valving member.

7. The apparatus of claim 3, wherein at least some of said passages defined by said control member are defined between lands formed on said control member and said piston being slidably supported on said lands.

8. The apparatus of claim 3, wherein said source of pressurized fluid comprises fluid pressure at said valve inlet.

9. The apparatus of claim 3 wherein said main valving member and said solenoid operated valving member operate along a common line of action.

* * * * *